United States Patent [19]

Hoene

[11] 4,070,601

[45] Jan. 24, 1978

[54] CIRCUIT ARRANGEMENT FOR IGNITING AT LEAST ONE GAS DISCHARGE FLASH TUBE

[75] Inventor: Ernst-Ludwig Hoene, Singapore, Singapore

[73] Assignee: Heinmann GmbH, Germany

[21] Appl. No.: 673,974

[22] Filed: Apr. 5, 1976

[30] Foreign Application Priority Data

Apr. 15, 1975 Germany ..... 2516381

[51] Int. Cl.[2] ..... H05B 41/23

[52] U.S. Cl. ..... 315/241 R; 315/187; 315/189; 315/231; 315/240; 315/324

[58] Field of Search ..... 315/178, 179, 183, 185 R, 315/187–189, 227 R, 228, 231, 232, 240, 241 R, 241 P, 241 S, 324; 354/135

[56] References Cited

U.S. PATENT DOCUMENTS 3,782,258 1/1974 Boekkool et al. ..... 315/241 P

FOREIGN PATENT DOCUMENTS 1,200,615 7/1970 United Kingdom ..... 315/241 P

*Primary Examiner*—Eugene R. La Roche

*Attorney, Agent, or Firm*—Hill, Gross, Simpson, Van Santen, Steadman, Chiara & Simpson

[57] ABSTRACT

A circuit arrangement for igniting at least one gas discharge flash tube having two main electrodes includes a chargeable flash capacitor connected in parallel with the flash tube and an electronic switch. These elements are connected to a voltage generator which supplies ignition voltage pulses and the electronic switch constitutes a gas discharge path for the flash tube. The voltage generator has such a low impedance, in particular a low inductance, that the ignition voltage pulses supplied thereby at least approximately adiabatically heat the gas discharge paths.

8 Claims, 2 Drawing Figures

CIRCUIT ARRANGEMENT FOR IGNITING AT LEAST ONE GAS DISCHARGE FLASH TUBE

BACKGROUND OF THE INVENTION

1. Field of the Invention

This invention relates to a circuit arrangement for igniting at least one gas discharge flash tube of the type having at least two main electrodes and connected in parallel with a chargeable flash capacitor.

2. Description of the Prior Art

The British patent application No. 36843/75 discloses a circuit arrangement for igniting at least one gas discharge flash bulb (flash tube) having two main electrodes which are arranged in parallel with a chargeable flash capacitor and an electronic switch and are connected to a voltage generator which supplies ignition voltage pulses, the electronic switch likewise constituting a gas discharge path.

A circuit arrangement of this type is characterized, in particular, in that the blocking diodes in the discharge circuit which are usually required in parallel ignition and which be designed for high blocking voltages and high forward currents can be eliminated, and that ignition voltage pulses of both polarities can operate on the flash tube. Particular advantages are obtained if a plurality of flash tubes are operated in series as, in this case, one of the flash tubes can itself be used as an electronic switch in the form of a gas discharge path.

However, when the above-described circuit is operating with one of the conventional ignition transformers, as disclosed in the German published application 2,422,201 which corresponds to U.S. Pat. No. 3,838,358, as a voltage generator, the following problem can occur. In order to ensure that every tube ignition reliably leads to a flash discharge, the flash capacitor must apply a voltage ("anode voltage") which is a multiple greater than the theoretically required burning voltage.

SUMMARY OF THE INVENTION

It is therefore the object of the present invention to provide a flash arrangement in which tube ignition leads to a flash discharge without the necessity of a flash capacitor providing a high anode voltage.

In order to realize this objective, in a circuit arrangement of the type disclosed in the aforementioned British patent application No. 36843/75, it is provided, in accordance with the present invention, that the voltage generator possess such a low impedance, in particular a low inductance, that the ignition voltage pulses which it supplies at least approximately adiabatically heat the gas discharge paths.

The present invention is based upon the following considerations. As is well known in the art, a gas discharge is initiated in that, firstly, the ignition pulse forms a conductive preliminary channel, also called a "plasma filament", in the flash tube, and then this plasma filament, provided the same is of a sufficiently low resistance, is expanded by the anode voltage, i.e., the filament resistance is further reduced until finally the tube assumes the actual, luminous discharge state. Recent investigations have shown that, in the case of adiabatic heating of the preliminary channel, there is a strict functional relationship between the electrical energy fed into the channel and the resistance of the channel, so that with increasing energy supply the resistance drops. However, adiabatic heating occurs only when the energy is fed-in within a period of time which is such that the plasma filament is unable to return to the environment any part of the energy worthy of note due to heat conduction and radiation losses. In order to obtain a channel having a resistance of, for example, 1 ohm under normal flash tube conditions, the channel must be supplied with a quantity of energy in the order of 1000 $\mu$Ws within an interval of time of less than 1 $\mu$sec.

Conventional ignition transformers have high secondary impedances, as such transformers must emit high frequency voltages having amplitudes of a few kV, and as their primary end peak current strengths are governed by limits due to the danger of overloading the switching contacts and the switching thyristors. At these high impedances, the required energy cannot be made available sufficiently rapidly, and, therefore, the preliminary channel which forms following the breakthrough is also not approximately adiabatically heated, and, consequently, reaches a state of conductivity at which it requires an anode voltage which exceeds the burning voltage by a multiple in order to be conveyed into the desired flash discharge.

In comparison, a circuit arrangement constructed in accordance with the present invention contains a low impedance, in particular low inductance, voltage generator which, when of suitable design, facilitates at least quasi-adiabatic filament heating, and thus at least converts the given ignition energy into the maximum possible filament conductivity, and furthermore, in particular, also ensures a reliable flash tube discharge at anode voltages which are similar to the burning voltage.

A voltage generator provided in accordance with the present invention can be constructed, for example, in that capacitances are added to an ignition transformer. However, it is also possible to reduce the inductive impedance component of the transformer possibly by selecting a transformer core having a low permeability. Preferably, the voltage generator is set up for an ignition electrode-free parallel ignition.

Advantageously, the voltage generator of a circuit arrangement constructed in accordance with the present invention basically possesses only a capacitive impedance component. If a conventional capacitor which can be charged by a second voltage source is used, the resistance of this source (internal resistance in the case of a d.c. voltage source) is to be very much greater than the internal resistance of the flash tube on the initiation of the actual discharge, so that the flash capacitor does not discharge by way of this voltage source, even without the assistance of further blocking means. Instead of a conventional capacitor, however, it is also possible to use other capacitances, in particular piezoelectric crystals or pyro-electric crystals. Voltage generators constructed with crystals of this type prove particularly favorable as the crystal impedance increases with decreasing frequency, and, therefore, the crystals present a comparatively high resistance to the actual low frequency discharge, and are thus automatically blocked therefrom. Parallel connected ignition transformers, on the other hand, because of the fact that their impedance decreases with decreasing frequency, must usually be protected from the discharge current by additional precautions, such as diodes. Thus, on account of their virtually ideal matching to the flash tube, capacitive voltage generators lead to further circuitry simplifications.

If a gas discharge path is fed with an ignition pulse, its breakthrough does not occur immediately, but in a delayed manner with a statistical distribution about an average delay time. These fluctuations could, in the case of the ignition of a plurality of gas discharge paths, lead to the premature breakthrough of one of these discharge paths, and to the ignition energy being discharged via this discharge vessel without igniting the other paths. If ignition is effected with a high induction voltage generator, the tendency to incomplete discharge is generally low due to the comparatively long time required for the formation of the plasma filament. In a circuit arrangement constructed in accordance with the present invention, having a voltage generator which feeds in at high speed, this danger cannot, however, always be disregarded. In a further development of the invention, it is therefore provided that in the proposed circuit arrangement, between the voltage generator and the gas discharge paths, each of which paths have a specific breakthrough voltage, a second electronic switch is connected which does not open and allow the ignition voltage pulses to reach the gas discharge paths until the ignition voltage pulses supplied by the voltage generator have each assumed values above the maximum breakthrough voltage. The electronic switch then remains conductive down to a voltage value of, for example, 100 V, which is low in comparison to the breakthrough voltages. Preferably, the applied ignition voltage is clearly higher than the maximum breakthrough voltage, for example between 5 and 15%, and in particular around 10%, as the statistical fluctuation range for the time at which the discharge begins reduces with increasing ignition voltage.

BRIEF DESCRIPTION OF THE DRAWING

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
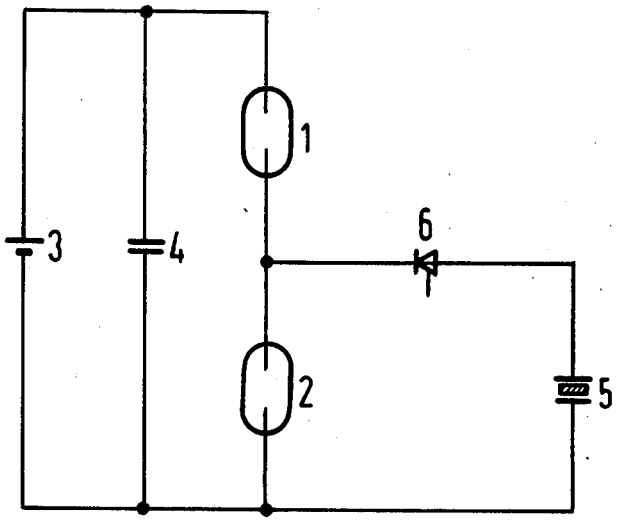
FIG. 1 is a schematic circuit diagram of a first exemplary embodiment of a circuit arrangement constructed in accordance with the present invention.

All of the components of an ignition circuit which do not contribute to the understanding of the present invention, for example switching contacts and possibly required resistors, have been omitted from the drawing for the purpose of clarity, those skilled in the art being well aware of the existence and conventional utilization of such components.

In the circuit illustrated in FIG. 1, two gas discharge vessels 1 and 2 are connected in the circuit of a d.c. voltage source 3 in series with each other and in parallel with a flash capacitor 4. At least one of the two discharge vessels, for example the vessel 2, is in the form of a flash tube.

A low impedance voltage generator 5 which, in the present case, is a piezoelectric crystal, is connected, on the one hand, between the flash capacitor 4 and one of the two discharge vessels and, on the other hand, by way of a semiconductor switch 6 serving as an electronic switch, the voltage generator 5 is connected to the junction of two main electrodes of the two vessels 1 and 2.

During the operation of the circuit, the high voltage produced in the piezoelectric crystal 5 does not reach the gas discharge vessels 1 and 2 until the electronic switch is opened. The gas discharge vessels 1 and 2 then ignite and discharge the flash capacitor 4. The electronic switch 6 serves to ensure that the high voltage is not allowed to reach the two main electrodes of the discharge vessels until such voltage has attained the particular higher breakthrough voltage of the two vessels. This avoids the premature ignition of one vessel, and a lack of breakthrough in the other vessel because there has been too great of a drop in voltage between its main electrodes.

Figure 2:
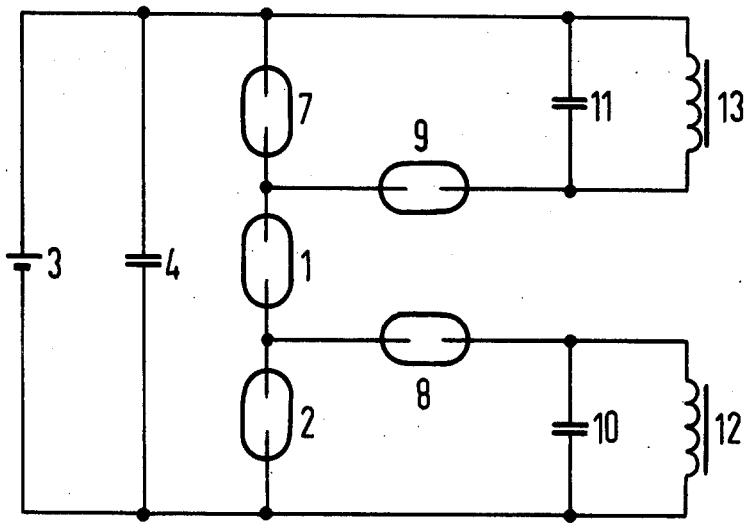
FIG. 2 is a schematic circuit diagram of a second exemplary embodiment of the circuit arrangement constructed in accordance with the present invention.

The circuit illustrated in FIG. 2 differs from the above embodiment of FIG. 1 in that, first of all, three instead of two gas discharge vessels are provided, the vessels 1, 2 and 7. In addition, two electronic switches 8 and 9 are provided instead of one. In this case, in fact, the two electronic switches are gas discharge vessels 8 and 9 and are connected to respective voltage generators.

The individual voltage generators respectively comprise an ignition capacitor 10 and 11, each of which is connected in parallel to the secondary end of a respective ignition transformer 12 and 13. The one ignition voltage generator is connected, on the one hand, between the flash capacitor 10 and the vessel 2 and, on the other hand, by way of the electronic switch 8, between the vessels 2 and 1 to the discharge circuit, whereas the other ignition voltage generator is connected to the discharge circuit, on the one hand, between the flash capacitor 11 and the vessel 7 and, on the other hand, by way of the electronic switch 9 between the vessels 1 and 7.

The invention is not limited to the exemplary embodiments illustrated on the drawing. Thus, the electronic switches cannot only be in the form of semiconductor switches or triggered or untriggered gas discharge paths, but also other components which are either triggered or which automatically ignite when a specific voltage is reached.

The low impedance high voltage generators cannot only be in the form of piezoelectric crystals or pyroelectric crystals, or capacitances which can be charged by way of a conventional ignition transformer, but also ignition transformers having a low impedance. In addition, it is possible to dispense with the use of switches between the voltage generator and gas discharge paths if it is insured in another way that in spite of the high discharge speed, all of the gas discharge paths ignite and discharge reliably. Finally, it is of no importance to the invention how many gas discharge paths and voltage generators are employed.

Although I have described my invention by reference to particular illustrative embodiments thereof, many changes and modifications, other than those noted above, may become apparent to those skilled in the art without departing from the spirit and scope of the invention. I therefore intend to include within the patent warranted hereon all such changes and modifications as may reasonably and properly be included within the scope of my contribution to the art.

I claim:

1. In a flash arrangement of the type wherein a chargeable flash capacitor is connected in a charging path and in parallel with a plurality of serially-connected electronic gas discharge devices including at least one flash tube which has only two electrodes for supporting both ignition and discharge, and wherein the flash tube is connected via an electronic switch to a voltage generator which supplies ignition pulses, the electronic discharge devices constituting a discharge path for said flash capacitor and the electronic switch constituting an ignition switch, the improvement, in combination therewith, wherein:

said voltage generator comprises a low internal impedance which causes the ignition voltage pulses to at least approximately and rapidly adiabatically heat the plasma channel produced in the flash tube of the gas discharge path.

2. The improved flash arrangement of claim 1, wherein said voltage generator is capacitive and comprises a piezoelectric crystal.

3. The improved flash arrangement of claim 1, wherein said voltage generator is capacitive and comprises a pyro-electric crystal.

4. The improved flash arrangement of claim 1, wherein:

each of the discharge devices is a two-electrode device having a specific breakthrough voltage; and said electronic switch comprises a plurality of electronic switching elements connected between said ignition voltage generator and respective junctions of the serially connected discharge devices, each of said switching elements becoming conductive in response to ignition voltage pulses above the highest breakthrough voltage and remaining conductive down to a voltage which is low in comparison to the breakthrough voltages.

5. The improved flash arrangement of claim 1, wherein said electronic switch comprises a control electrode for receiving control voltages to open and close said second electronic switch.

6. The improved flash arrangement of claim 1, wherein said electronic switch is a semiconductor switch.

7. The improved flash arrangement of claim 1, wherein said electronic switch is a gas discharge tube.

8. In a flash arrangement of the type wherein a chargeable flash capacitor is connected in a charging path and in parallel with a plurality of serially-connected electronic gas discharge devices including at least one flash tube which has only two electrodes for supporting both ignition and discharge, and wherein the flash tube is connected via an electronic switch to a voltage generator which supplies ignition pulses, the electronic discharge devices constituting a discharge path for said flash capacitor and the electronic switch constituting an ignition switch, the improvement, in combination therewith, wherein:

said voltage generator comprises a low internal inductance which causes the ignition voltage pulses to at least approximately and rapidly adiabatically heat the plasma channel produced in the flash tube of the gas discharge path.

* * * * *